US011846492B2

(12) United States Patent
Chang

(10) Patent No.: US 11,846,492 B2
(45) **Date of Patent: *Dec. 19, 2023**

(54) MOTION ACTIVATED BOW SIGHT LIGHT

(71) Applicant: Yuan Chang, Albany, NY (US)

(72) Inventor: Yuan Chang, Albany, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/888,182

(22) Filed: Aug. 15, 2022

(65) Prior Publication Data

US 2022/0390208 A1 Dec. 8, 2022

Related U.S. Application Data

(63) Continuation-in-part of application No. 17/032,612, filed on Sep. 25, 2020, now Pat. No. 11,415,390.

(60) Provisional application No. 62/922,564, filed on Aug. 16, 2019.

(51) Int. Cl.
*F41G 1/34* (2006.01)
*F41G 1/467* (2006.01)

(52) U.S. Cl.
CPC ..... *F41G 1/345* (2013.01); *F41G 1/467* (2013.01)

(58) Field of Classification Search
CPC ..... F41G 1/345; F41G 1/467
See application file for complete search history.

(56) References Cited

U.S. PATENT DOCUMENTS

| | | | | |
|---|---|---|---|---|
| 5,339,227 | A | 8/1994 | Jones | F21V 33/008 124/87 |
| 2006/0007678 | A1 | 1/2006 | Nichols | F41G 1/345 362/227 |
| 2007/0032885 | A1 | 2/2007 | Cross | F41G 1/345 700/12 |
| 2007/0068018 | A1 | 3/2007 | Gilmore | F41G 1/473 33/265 |
| 2010/0043765 | A1* | 2/2010 | Lang | F41B 5/1403 124/88 |
| 2010/0170136 | A1 | 7/2010 | Buckingham | F41G 1/345 42/132 |
| 2013/0000622 | A1* | 1/2013 | McCauley | F41G 11/001 124/88 |
| 2016/0169622 | A1 | 6/2016 | Graziano | F41B 5/10 124/25.6 |
| 2018/0180381 | A1 | 6/2018 | Grace, Jr. | F41G 1/38 |
| 2019/0056197 | A1* | 2/2019 | Matthews | F41G 1/467 |
| 2019/0078857 | A1 | 3/2019 | Vergara | F41B 5/1403 |
| 2019/0212417 | A1* | 7/2019 | Strange | G01S 17/88 |

(Continued)

*Primary Examiner* — Alexander K Garlen
(74) *Attorney, Agent, or Firm* — SZDC LAW P.C.

(57) ABSTRACT

A bow sight light mounting kit for illuminating an archery bow includes a bow sight light control unit that includes a power source, a motion sensor, and a customizable timer; an LED light, the LED light adapted for being attached to the bow sight light control unit; and a first mounting plate, the first mounting plate attaching the bow sigh light control unit to the archery bow. The motion sensor detects a movement of the archery bow and sends a signal to the customizable timer; wherein the customizable timer adjusts the LED light to mode-1 after receiving the signal and keeps the LED light on mode-1 for a pre-set time period; the customizable timer adjusts the LED light to mode-2 after the pre-set time period; and the mode-1 and mode-2 are pre-set by a user to control a brightness and a blinking frequency of the LED light.

11 Claims, 7 Drawing Sheets

(56) References Cited

U.S. PATENT DOCUMENTS

| | | | | |
|---|---|---|---|---|
| 2020/0033093 | A1* | 1/2020 | Kruger | F41G 1/467 |
| 2020/0109915 | A1 | 4/2020 | Wagner | F21V 23/0442 |
| 2020/0232760 | A1 | 7/2020 | Theisinger | F41G 1/345 |

* cited by examiner

MOTION ACTIVATED BOW SIGHT LIGHT

The present application is a continuation-in-part application of U.S. Nonprovisional application Ser. No. 17/032,612, filed on Sep. 25, 2020, which claims priority to U.S. Provisional Patent Application No. 62/922,564, filed on Aug. 16, 2019, which is incorporated by reference for all purposes as if fully set forth herein.

BACKGROUND OF THE INVENTION

The present invention is in the technical field of archery accessory. More particularly, the present invention is in the technical field of motion-activated bow sight illumination devices.

An archery bow includes many parts, for example, a bow riser, and a bow sight. A bow sight includes a ring and one or multiple sight pins which hold optical fibers for the archer to aim. In order to enhance the contrast between the optical fiber pins and the ambient lighting, one often uses a bow sight light to illuminate the optical fiber(s). A typical bow sight light includes a battery, an LED, a switch, and a mount to install it to a bow sight. Due to the limited size and weight of a bow sight light. Only a small battery can be included. To conserve the battery, archers often turn the sight light on when shooting, and turn it off when shooting is completed. Such action creates unnecessary distraction, especially in a competitive shooting event.

BRIEF SUMMARY OF THE INVENTION

In one embodiment, the present application provides a bow sight light mounting kit for illuminating an archery bow. The bow sight light control unit that includes a power source, a motion sensor, and a customizable timer; an LED light, the LED light adapted for being attached to the bow sight light control unit; and a first mounting plate, the first mounting plate attaching the bow sigh light control unit to the archery bow. The motion sensor detects a movement of the archery bow and sends a signal to the customizable timer; the customizable timer adjusts the LED light to mode-1 after receiving the signal and keeps the LED light on mode-1 for a pre-set time period; the customizable timer adjusts the LED light to mode-2 after the pre-set time period; and the mode-1 and mode-2 are pre-set by a user to control a brightness and a blinking frequency of the LED light.

In another embodiment, the pre-set time period is 10 seconds, 15 seconds, 20 seconds, 25 seconds, 30 seconds, 40 seconds, 50 seconds, 60 seconds, 80 seconds, 100 seconds, 150 seconds, 200 seconds, 300 seconds, 450 seconds, or 600 seconds.

In another embodiment, the bow sight light mounting kit further includes a plurality of screws. The screws securely connect the bow sight light control unit and the first mounting plate to the archery bow, and a part of the archery bow is sandwiched between the bow sight light control unit and the first mounting plate.

In another embodiment, the screws are hex screws or square screws.

In another embodiment, the first mounting plate includes a plurality of openings having a hex, a square, or a rectangle shape; the screws pass through the openings and are firmly held in the openings; and the screws slide within the opening having the rectangle shape.

In another embodiment, the bow sight light mounting kit further includes a second mounting plate. The screws securely connect the first mounting plate and the second mounting plate to the archery bow, and a part of the archery bow is sandwiched between the first mounting plate and the second mounting plate. The bow sight light control unit is connected to the first mounting plate.

In another embodiment, the bow sight light mounting kit further includes a third mounting plate that has a long strip shape. The third mounting plate connects to the first mounting plate to the archery bow.

In another embodiment, the bow sight light mounting kit further includes a fastening strip. The fastening strip securely connects the first mounting plate to the archery bow.

In another embodiment, the fastening strip is a nylon hook fastening strip.

In another embodiment, the present application provides an archery bow that includes: a bow riser; a bow sight; a bow sight light control unit that includes a power source, a motion sensor, and a customizable timer; and an LED light, the LED light adapted for being attached to the bow sight light control unit. The bow sight light control unit of the bow sight light mounting kit is connected onto the bow sight by a fastening strap; the motion sensor detects a movement of the archery bow and sends a signal to the customizable timer; the customizable timer adjusts the LED light to mode-1 after receiving the signal and keeps the LED light on mode-1 for a pre-set time period; the customizable timer adjusts the LED light to mode-2 after the pre-set time period; and the mode-1 and mode-2 are pre-set by a user to control a brightness and a blinking frequency of the LED light.

In another embodiment, the fastening strap is a zip tie, a hook and loop strap, a self-adhesive tape strap, a nylon webbing, or a heat shrink tube.

It is to be understood that both the foregoing general description and the following detailed description are exemplary and explanatory and are intended to provide further explanation of the invention as claimed.

DETAILED DESCRIPTION OF THE INVENTION

Figure 1:
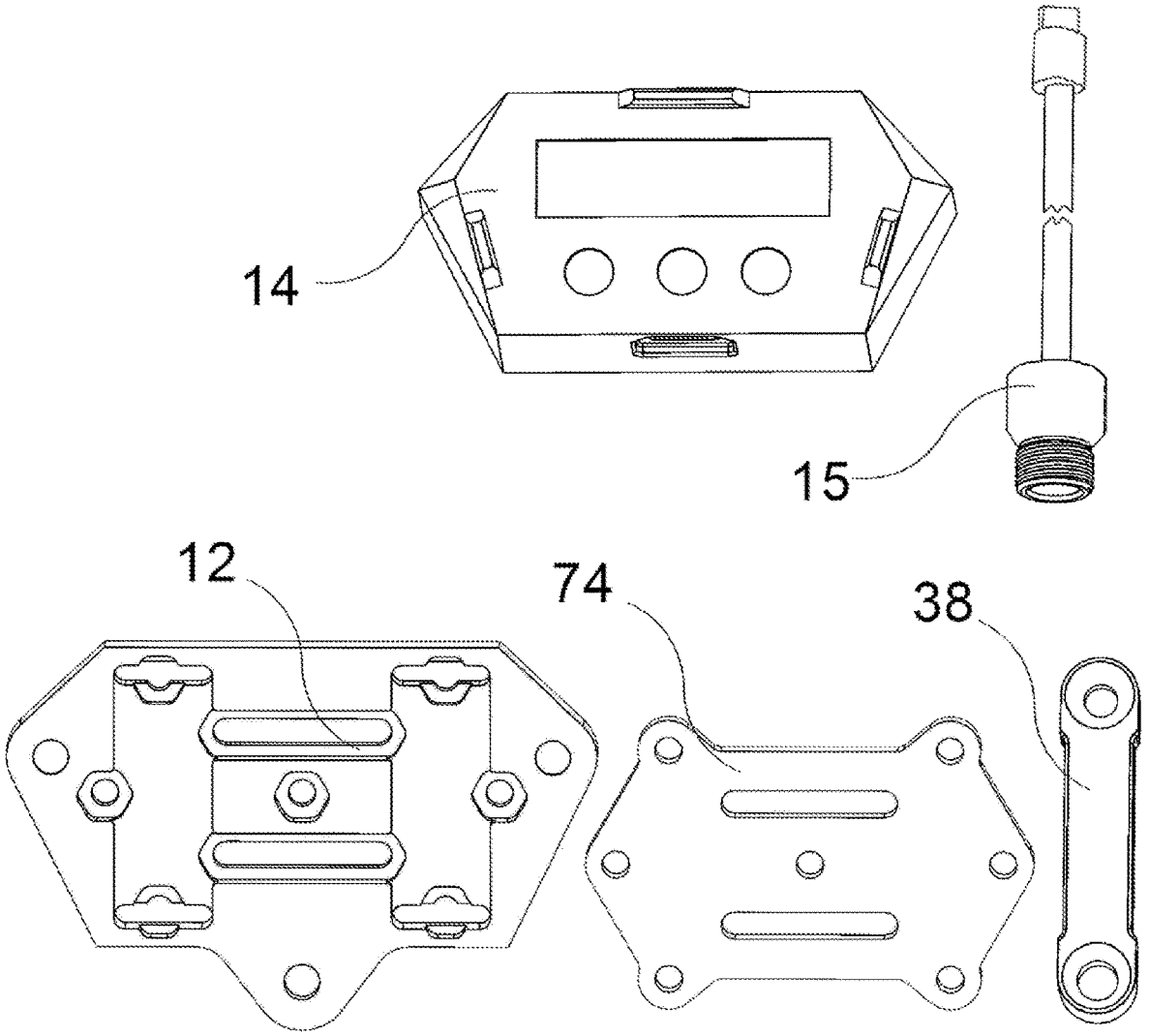
FIG. 1 is a perspective view of the essential components of the motion activated bow sight light.

Referring now to the invention in more detail, in FIG. 1 there is shown a motion activated bow sight light control unit with its detachable LED 15, mounting plate A 12, mounting plate B 74, and mounting plate C 38.

The LED 15 can be attached and detached via an electronic port on the motion activated bow sight light control unit, such as Micro-USB, or USB-C.

Figure 2:
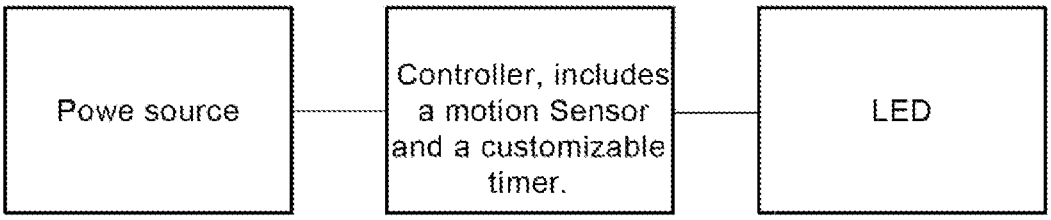
FIG. 2 is a box diagram of a motion activated bow sight light.

Referring now to the invention in more detail, in FIG. 2 there is shown a motion activated bow sight light control unit having a power source, a controller that includes a motion sensor and a customizable timer to control the on and off function of the LED 15.

In further detail, still referring to the invention of FIG. 2, the motion sensor is capable of sensing micro movement such as a person touching the bow. The customizable timer can be set from a few seconds to a few minutes. The pre-set time period can be, for example, 10 seconds, 15 seconds, 20 seconds, 25 seconds, 30 seconds, 40 seconds, 50 seconds, 60 seconds, 80 seconds, 100 seconds, 150 seconds, 200 seconds, 300 seconds, 450 seconds, or 600 seconds.

Figure 3:
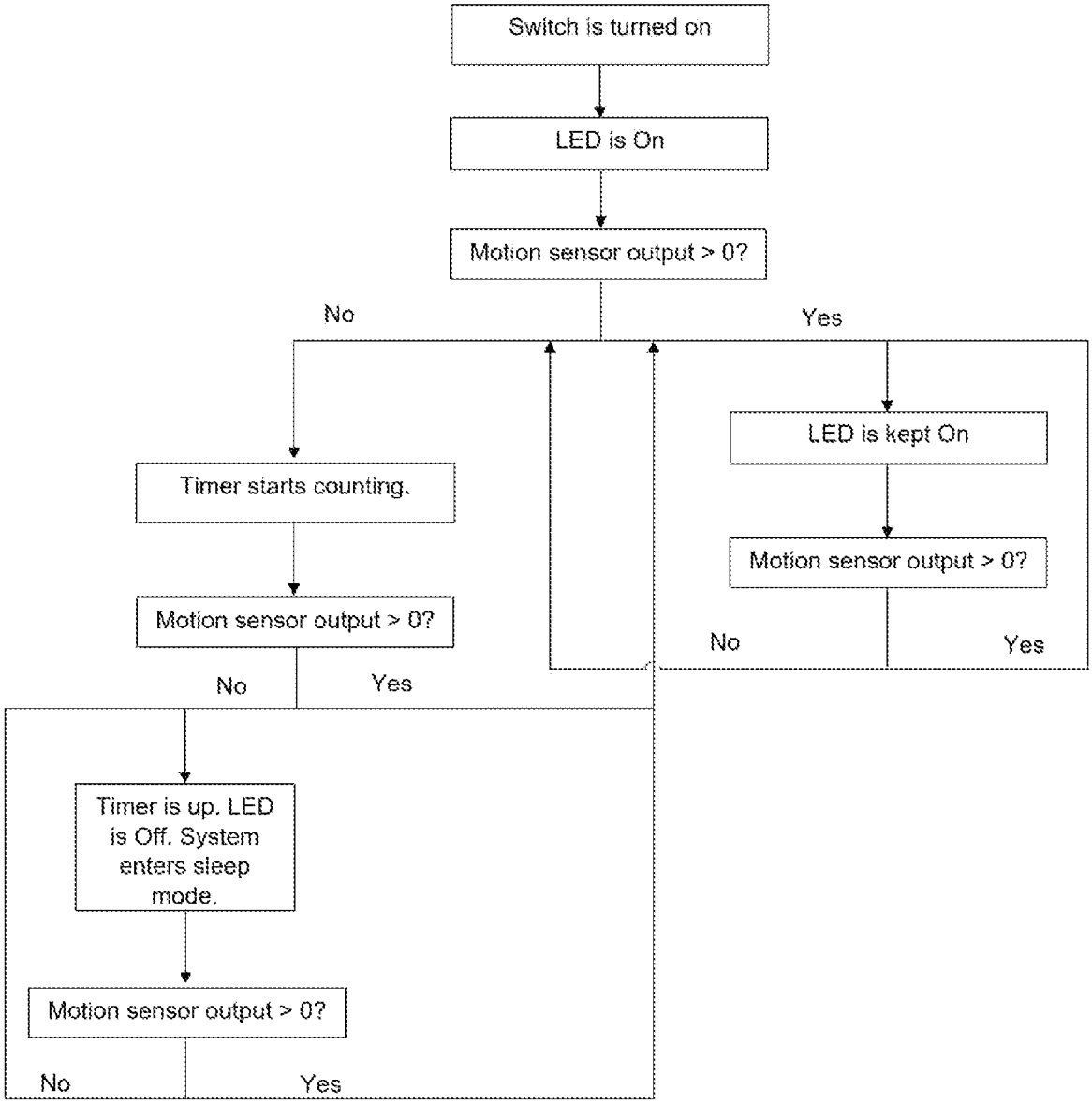
FIG. 3 is a flowchart illustrating the programming of the controller.

Referring now to the invention shown in FIG. 3, in use, the user turns on motion activated bow sight light control unit, the LED 15 is on. The controller constantly monitors the output of the motion sensor. If the light is in motion, the motion sensor produces a positive signal, such as +3 Volts and sends the signal to the customizable timer. The timer adjusts the LED light to mode-1 after receiving the signal and keeps the LED light on mode-1 for a pre-set time period. Mode-1 can be, for example, keeping LED 15 on. After the pre-set time period, the timer adjusts the LED light to mode-2. Mode-2 can be, for example, "sleep" mode or turning off the LED light. If the light is motion-less, such as been stored in a shelf, the motion sensor stops producing the positive signal. The controller still keeps the LED 15 on. Meanwhile the timer starts counting the time that the light is motion-less. If the time that the light is motion-less exceeds the pre-set time, such as 30 seconds, the controller turns the LED 15 off, and enters "sleep" mode. If there was any motion before the controller entering the "sleep" mode, the controller immediately enters mode-1 and turns on the LED 15 while monitoring the output of the motion sensor. In "sleep" mode, the controller still monitors the output of the motion sensor. If the output is positive, such as the bow being picked up, the controller immediately turns on the LED 15, and exits "sleep" mode, while still monitoring the output of the motion sensor.

In order to ensure that the motion sensor can accurately sense the motion of a bow, the motion activated bow sight light control unit must be solidly mounted onto the bow sight, or the bow riser which is the main body of an archery bow. Considering the fact that there are hundreds of different bow sight and bow riser designs, three mounting plates 12, 74, 38 that can solidly mount the motion activated bow sight light control unit onto almost any bow are also developed.

Figure 4:
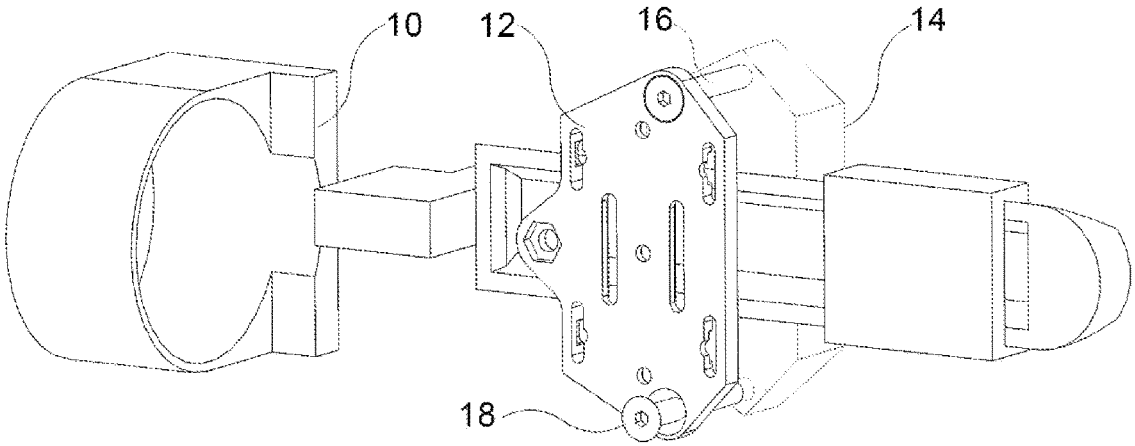
FIG. 4 is a perspective view of a motion activated bow sight light being mounted onto a bow sight.

Referring now to FIG. 4, there is shown a motion activated bow sight light control unit is being mounted onto a bow sight 10 by using a mounting plate A 12 and two screws 16, 18 to clamp onto the bow sight 10.

The construction details of the invention as shown in FIG. 4 are that the housing of the motion activated bow sight light control unit may be made of aluminum or of any sufficiently rigid and strong material such high-strength plastic, metal, and the like.

In more detail, still referring to the invention of FIG. 4, the screws 16, 18 can be of different lengths to clamp onto sights with different thicknesses. Such as about 5 to 40 mm thick.

Figure 5:
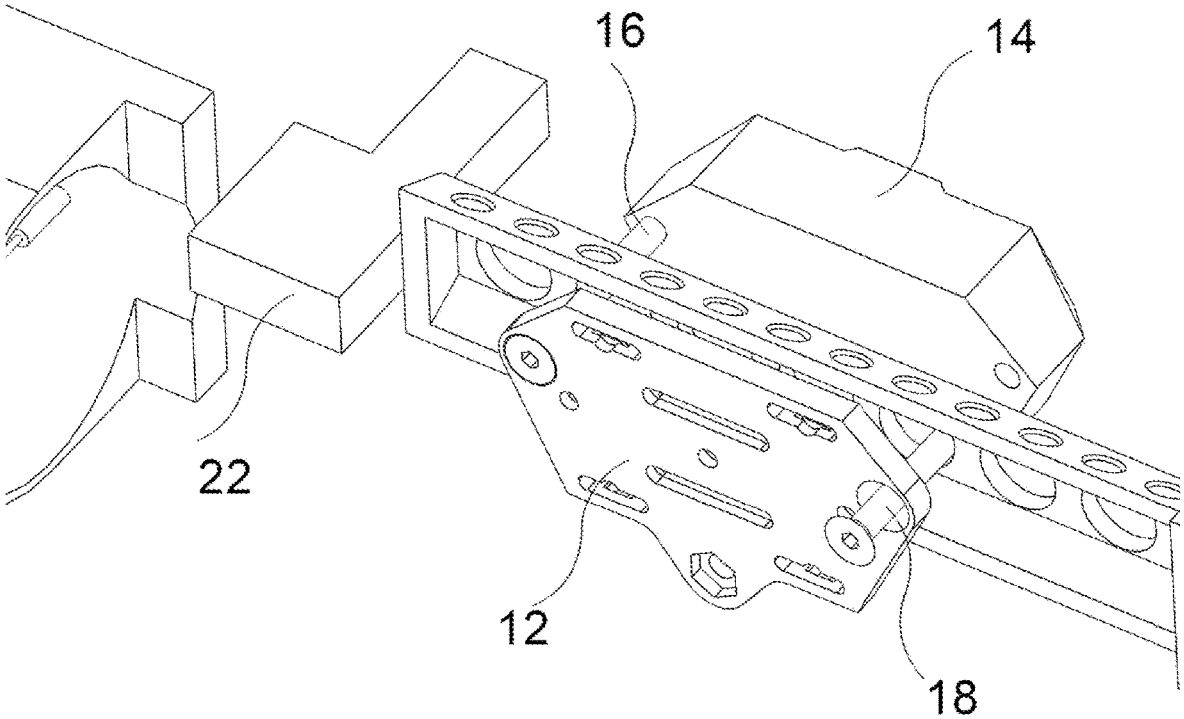
FIG. 5 is a perspective view of a motion activated bow sight light being mounted onto a bow sight.

Referring now to FIG. 5, there is shown a motion activated bow sight light control unit is being mounted onto a bow sight with holes 22 by using the mounting plate A 12 and two screws 16, 18 to clamp onto the bow sight with holes 22.

Figure 6:
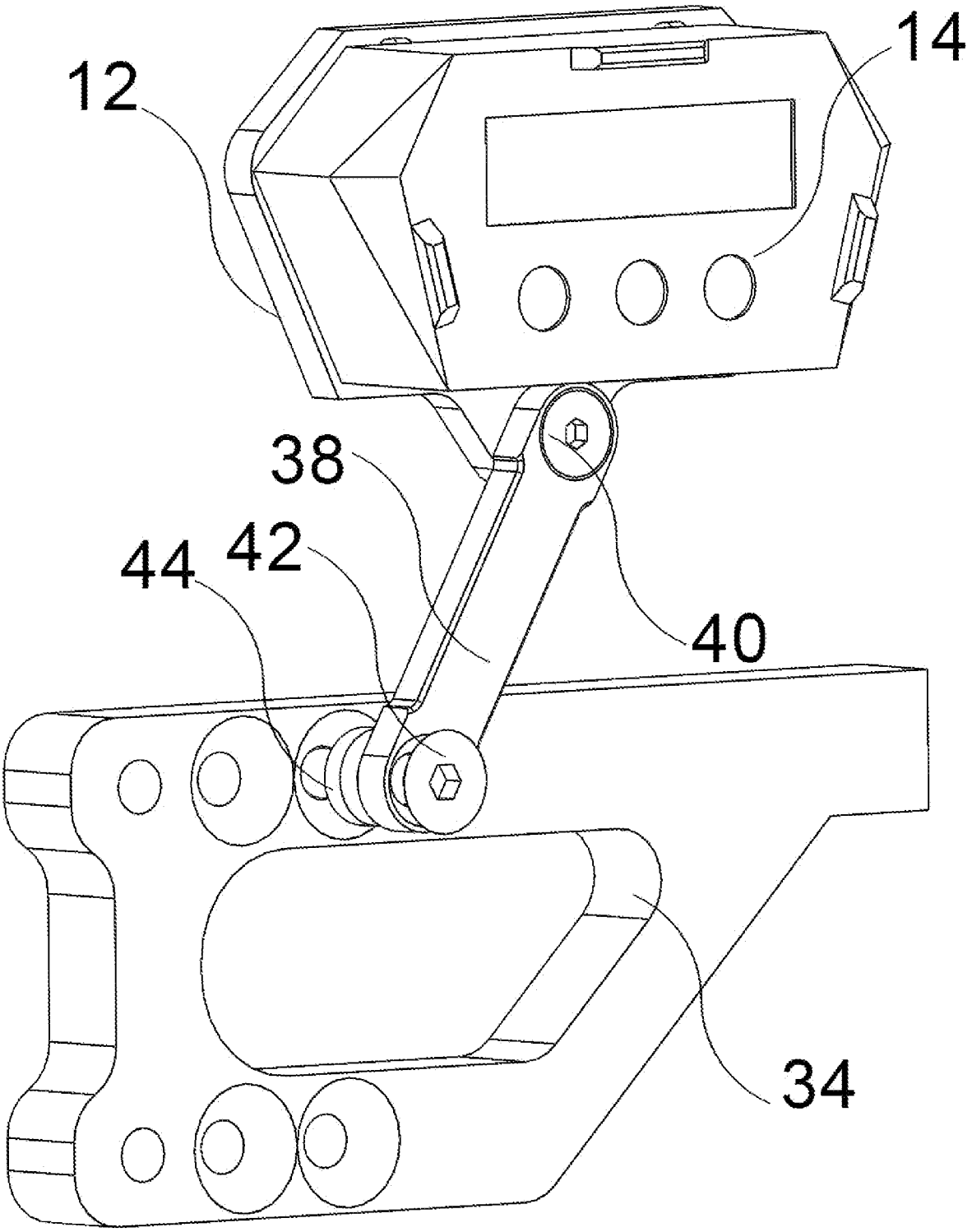
FIG. 6 is a perspective view of a motion activated bow sight light being mounted onto a bow sight.

Referring now to FIG. 6, there is shown a motion activated bow sight light control unit is being mounted onto a partially shown bow sight with irregular shape 34. The motion activated bow sight light control unit is mounted onto the mounting plate A 12. Mounting plate C 38 is also mounted to mount plate A 12 using a screw 40. Mounting plate C 38 is mounted onto the bow sight with irregular shape 34 by a screw 42 and an anti-slip washer 44.

Figure 7:
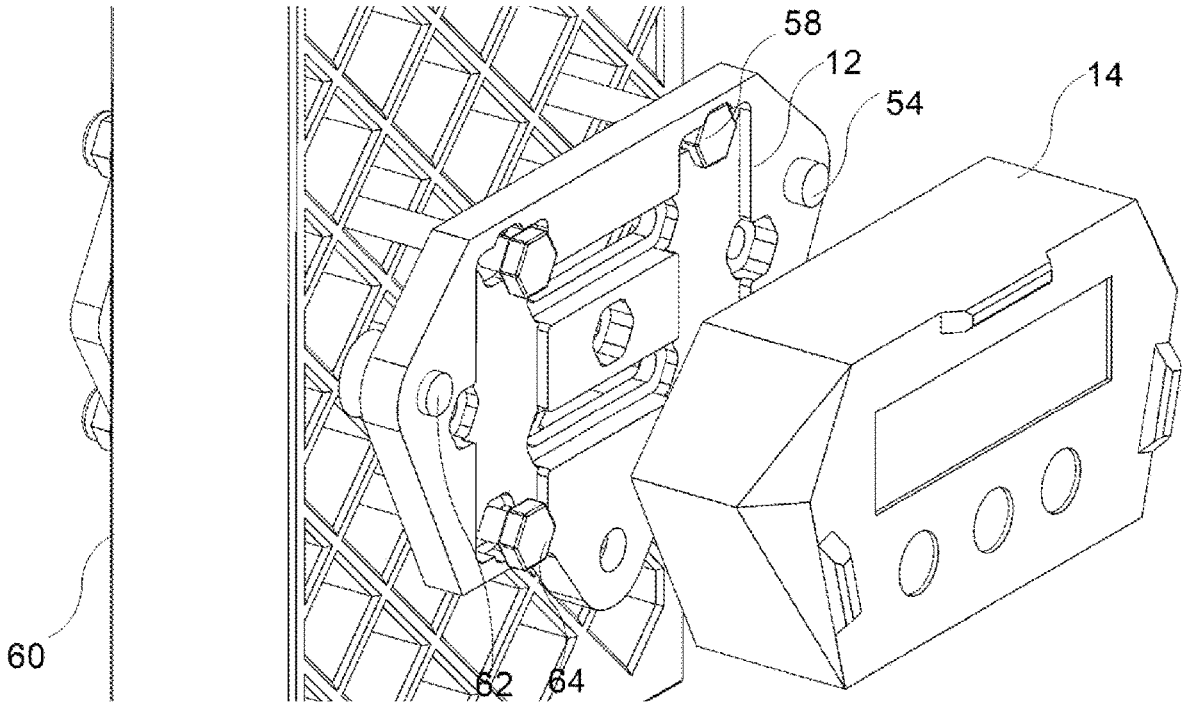
FIG. 7 is a perspective view of a motion activated bow sight light being mounted onto a bow riser.
Figure 8:
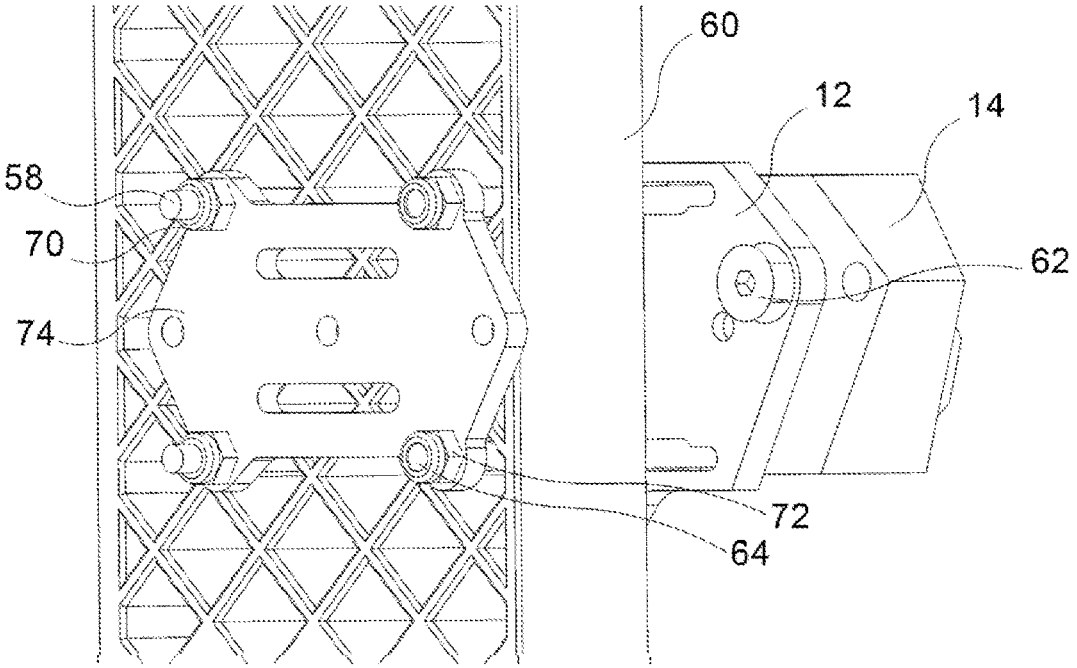
FIG. 8 is a perspective view of a motion activated bow sight light being mounted onto a bow riser.

Referring now to FIG. 7 and FIG. 8, there is shown a motion activated bow sight light control unit being mounted onto a grid style bow riser 60. The motion activated bow sight light control unit is first mounted onto the mounting plate A 12 using short screws 54, 62. Mounting plate A 12 has many holes that can let the threaded part of hex head screws 58, 64 go through, while firmly holding onto the hex head part. The hex heads can sink into the mounting plate A 12 to keep a flush surface. The hex head screws 58, 64 are then bolted onto mounting plate B 74 by nylon lock-nuts 70, 72. The holes on Mounting plate A 12 that can hold on to those hex head screws 58, 64 are matching the hole on mounting plate B 74. Therefore, more hex head screws can be used between mounting plate A 12 and B 74 to solidly clamp onto the grid style bow riser 60 or a bow sight with similar grid style built. While the hex head screws are used in the example, the screws for mounting plate A 12 to hold on to should not be limited to the hex head screws, but screws with square, triangle and rectangle heads.

In more detail, still referring to the invention of FIG. 7 and FIG. 8, the hex head screws 58, 64 can be of different lengths to clamp onto bow risers or sights with different thicknesses. Such as about 2 to 40 mm thick.

Figure 9:
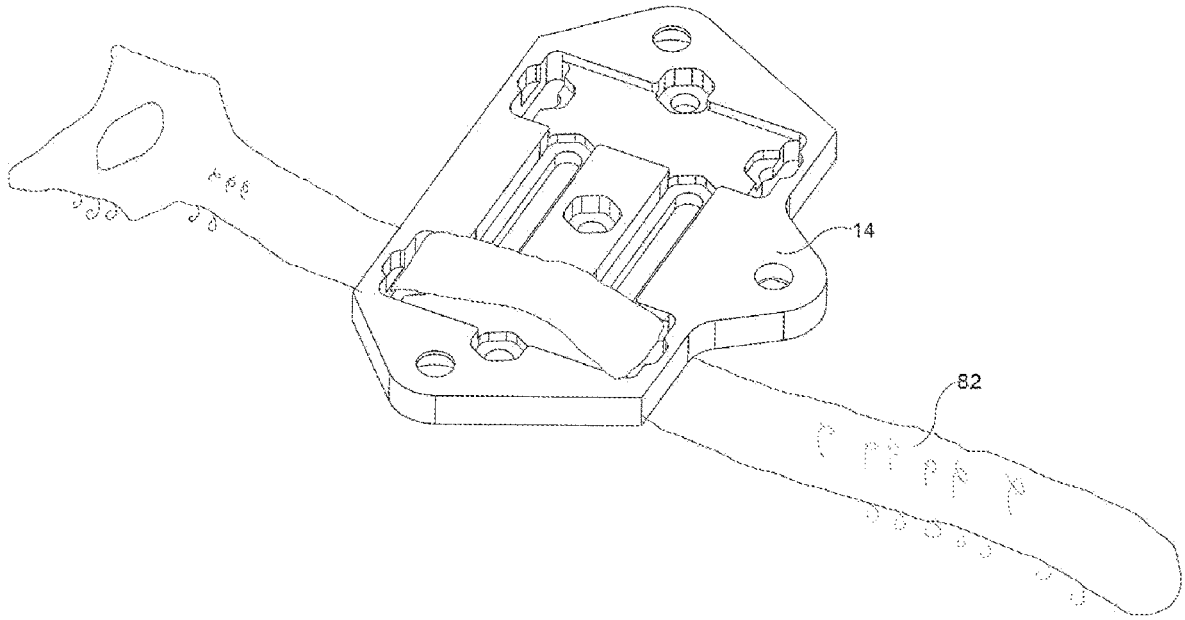
FIG. 9 is a perspective view of a nylon hook fastening strap mounted onto a mounting plate.

Referring now to FIG. 9, there is shown a nylon hook fastening strip 82 is being mounted onto the mounting plate A 12. Mounting plate A 12 is machined to have holes to let the nylon hook fastening strip 82 past through twice, and grooves to make the nylon hook fastening strip 82 stay flush with the surface of the mounting plate A 12.

Figure 10:
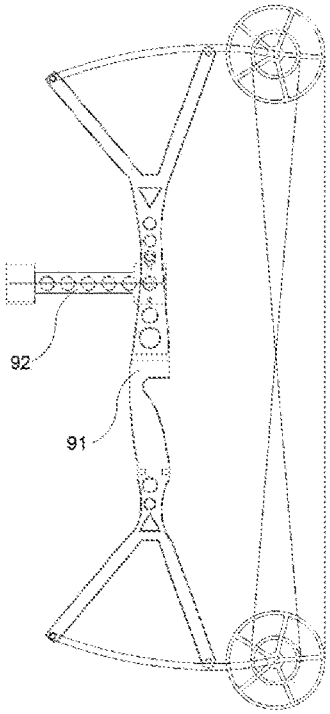
FIG. 10 is a perspective view of an archery bow including a bow riser, a bow sight.

Referring now to FIG. 10, there is shown a motion activated bow sight light control unit being glued onto an archery bow including a bow riser 91, bow sight 92, and other parts.

Figure 11:
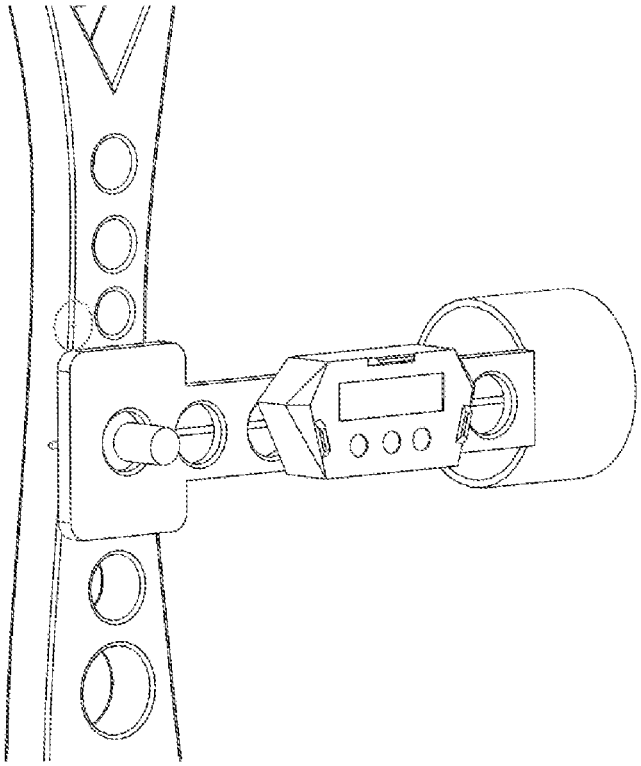
FIG. 11 is a perspective view of a motion activated bow sight light control unit being glued onto an archery bow.

Referring now to FIG. 11, there is shown glue is applied between the back of the motion activated bow sight light control unit, and a surface of the archery bow.

Figure 12:
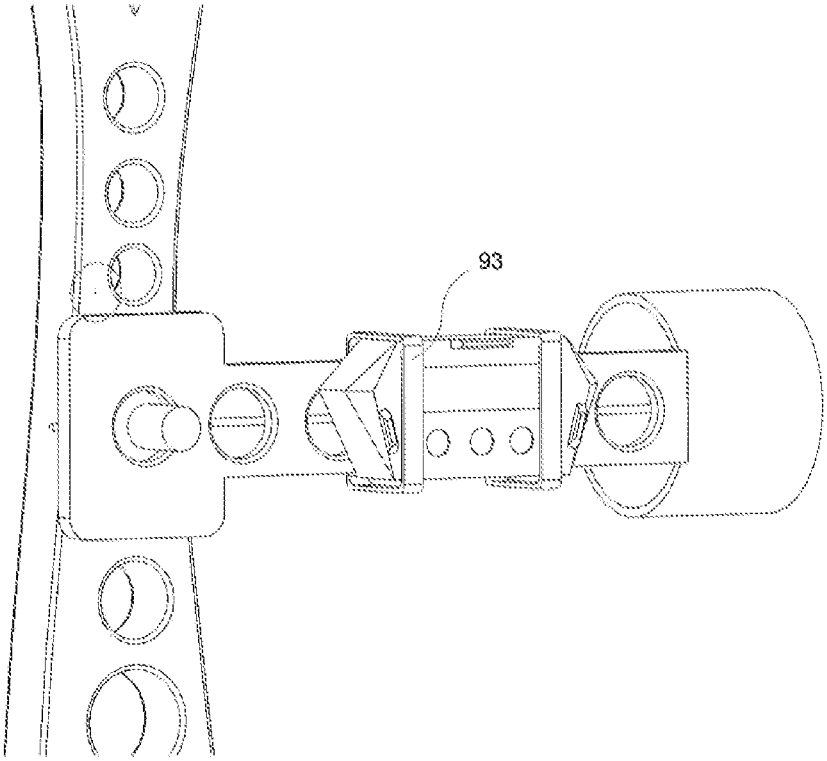
FIG. 12 is a perspective view of a motion activated bow sight light control unit being securely connected onto an archery bow by two fastening straps.

Referring now to FIG. 12, there is shown a motion activated bow sight light control unit being securely connected onto an archery bow by two fastening straps 93. Such fastening straps can be zip ties, hook and loop straps, self-adhesive tape straps, nylon webbing, heat shrink tubes, and the like.

The advantages of the present invention include, without limitation that it uses the motion sensor to control the On/Off of the LED, to provide the archer with illumination for the fiber optic pins of a bow sight as soon as they use the bow. It does not require the archer to manually turn the light on when shooting, and off when the shooting is completed. The customizable timer can be set to accommodate archers' personal preferences. The mounting system ensures that the motion activated bow sight light can be solidly mounted on almost any bow, whether mounted on the bow riser or bow sight, therefore, it enables the motion sensor to effectively and accurately sense the movement of the bow.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention as claimed.

The invention claimed is:

1. A bow sight light mounting kit for illuminating an archery bow, the bow sight light mounting kit comprising:

a bow sight light control unit that includes a power source, a motion sensor, and a customizable timer;

an LED light, the LED light adapted for being attached to the bow sight light control unit; and a first mounting plate, the first mounting plate attaching the bow sigh light control unit to the archery bow, wherein the motion sensor detects a micro movement of the archery bow and sends a signal to the customizable timer;

wherein the customizable timer adjusts the LED light to mode-1 after receiving the signal and keeps the LED light on mode-1 for a pre-set time period;

wherein the customizable timer adjusts the LED light to mode-2 after the pre-set time period;

wherein the mode-1 and mode-2 are pre-set by a user to control a brightness and a blinking frequency of the LED light; and wherein the micro movement of the archery bow comprises the user touching the bow.

2. The bow sight light mounting kit of claim 1, wherein the pre-set time period is 10 seconds, 15 seconds, 20 seconds, 25 seconds, 30 seconds, 40 seconds, 50 seconds, 60 seconds, 80 seconds, 100 seconds, 150 seconds, 200 seconds, 300 seconds, 450 seconds, or 600 seconds.

3. The bow sight light mounting kit of claim 1, further comprising:

a plurality of screws, wherein the screws securely connect the bow sight light control unit and the first mounting plate to the archery bow, and a part of the archery bow is sandwiched between the bow sight light control unit and the first mounting plate.

4. The bow sight light mounting kit of claim 3, wherein the screws are hex screws or square screws.

5. The bow sight light mounting kit of claim 4, wherein the first mounting plate includes a plurality of openings having a hex, a square, or a rectangle shape; the screws pass through the openings and are firmly held in the openings; and the screws slide within the opening having the rectangle shape.

6. The bow sight light mounting kit of claim 5, further comprising:

a second mounting plate, wherein the screws securely connect the first mounting plate and the second mounting plate to the archery bow, and a part of the archery bow is sandwiched between the first mounting plate and the second mounting plate; and wherein the bow sight light control unit is connected to the first mounting plate.

7. The bow sight light mounting kit of claim 6, further comprising:

a third mounting plate that has a long strip shape, wherein the third mounting plate connects the first mounting plate to the archery bow.

8. The bow sight light mounting kit of claim 1, further comprising:

a fastening strip, wherein the fastening strip securely connects the first mounting plate to the archery bow.

9. The bow sight light mounting kit of claim 8, wherein the fastening strip is a nylon hook fastening strip.

10. An archery bow comprising:

a bow riser;

a bow sight;

a bow sight light control unit that includes a power source, a motion sensor, and a customizable timer; and an LED light, the LED light adapted for being attached to the bow sight light control unit, wherein the bow sight light control unit of the bow sight light mounting kit is connected onto the bow sight by a fastening strap;

wherein the motion sensor detects a micro movement of the archery bow and sends a signal to the customizable timer;

wherein the customizable timer adjusts the LED light to mode-1 after receiving the signal and keeps the LED light on mode-1 for a pre-set time period;

wherein the customizable timer adjusts the LED light to mode-2 after the pre-set time period;

wherein the mode-1 and mode-2 are pre-set by a user to control a brightness and a blinking frequency of the LED light; and wherein the micro movement of the archery bow comprises the user touching the bow.

11. The archery bow of claim 10, wherein the fastening strap is a zip tie, a hook and loop strap, a self-adhesive tape strap, a nylon webbing, or a heat shrink tube.

* * * * *